US010857661B2

(12) United States Patent
Miksovsky et al.

(10) Patent No.: US 10,857,661 B2
(45) Date of Patent: Dec. 8, 2020

(54) TELESCOPING EATING UTENSIL

(71) Applicant: humangear, Inc., San Francisco, CA (US)

(72) Inventors: Christopher A. Miksovsky, San Francisco, CA (US); Steven R. Takayama, Atherton, CA (US); Kevin J. Kilpatrick, Mountain View, CA (US)

(73) Assignee: humangear, Inc., San Francisco, CA (US)

( * ) Notice: Subject to any disclaimer, the term of this patent is extended or adjusted under 35 U.S.C. 154(b) by 0 days.

(21) Appl. No.: 16/439,425

(22) Filed: Jun. 12, 2019

(65) Prior Publication Data

US 2019/0381651 A1 Dec. 19, 2019

Related U.S. Application Data

(60) Provisional application No. 62/685,672, filed on Jun. 15, 2018.

(51) Int. Cl.

| | |
|---|---|
| ***B25G 1/04*** | (2006.01) |
| ***A47G 21/02*** | (2006.01) |
| ***A47G 21/04*** | (2006.01) |

(52) U.S. Cl.

CPC ..... *B25G 1/04* (2013.01); *A47G 21/02* (2013.01); *A47G 21/04* (2013.01)

(58) Field of Classification Search

CPC ..... B25G 1/04; A47G 21/02; A47G 21/04; A47G 2021/002

USPC ..... 30/148, 322, 324

See application file for complete search history.

(56) References Cited

U.S. PATENT DOCUMENTS

| | | | |
|---|---|---|---|
| 32,916 | A | 7/1861 | Richards |
| 33,703 | A | 11/1861 | Hardie |
| 34,069 | A | 1/1862 | Neill |
| 34,712 | A | 3/1862 | Cables |
| 34,098 | A | 7/1862 | Hardie et al. |
| 46,832 | A | 3/1865 | Thorne |
| 88,370 | A | 3/1869 | Cox |
| RE7,925 | E | 10/1877 | Ulmer |

(Continued)

FOREIGN PATENT DOCUMENTS

| | | |
|---|---|---|
| CN | 2231889 | 7/1996 |
| CN | 2373000 | 4/2000 |

(Continued)

OTHER PUBLICATIONS

Alite, Cloverware Lite, http://shop.alitedesigns.com/cloverware-lite.html, downloaded on Mar. 6, 2014.

(Continued)

*Primary Examiner* — Hwei-Siu C Payer

(74) *Attorney, Agent, or Firm* — Beyer Law Group LLP

(57) ABSTRACT

A telescoping eating utensil capable of being stored in a collapsed configuration or extended to be used as an eating utensil. The utensil has a handle that can be extended or collapsed using an interlocking mechanism that can interlock the utensil in either the collapsed mode or in the extended mode. The interlocking system includes a locking button on a utensil tool part that engages with either an opening or a recess in the handle when the utensil tool part and the handle are slidably connected.

18 Claims, 10 Drawing Sheets

(56) References Cited

U.S. PATENT DOCUMENTS 9,687 A * 5/1881 Cox
RE9,687 E 5/1881 Cox
398,264 A 2/1889 Kisner
D30,129 S 2/1899 Whitcomb et al.
D31,575 S 10/1899 Phillips et al.
671,740 A 4/1901 Wattne
675,475 A 6/1901 Glover
812,424 A 2/1906 Hellmuth
849,098 A 4/1907 Aufrichtig
854,745 A 5/1907 King
870,413 A 11/1907 Brown
972,777 A 10/1910 Richardson
1,053,387 A 2/1913 Hawley
1,229,696 A 6/1917 Woods
1,271,679 A 7/1918 Duckett
1,277,205 A 8/1918 Evans
D53,165 S 4/1919 Janosik
1,337,174 A 4/1920 Whyte
1,348,762 A 8/1920 Suzuki
1,372,325 A 3/1921 Willemin
D59,869 S 11/1921 Quandee et al.
D60,369 S 2/1922 Quandee et al.
1,425,750 A 8/1922 Crawford
1,452,337 A 4/1923 Brecel
D63,047 S 7/1923 Adler
1,699,248 A 1/1929 Pasal
1,868,289 A 7/1932 Leidel
D93,956 S 11/1934 Wilson
1,984,081 A 12/1934 Pisculli
2,010,074 A 8/1935 Fuerst
2,109,016 A 2/1938 Ringer
2,251,842 A 8/1941 Hill
2,318,129 A 5/1943 Torode
D143,431 S 1/1946 Lapin
2,439,882 A 4/1948 Beddow
2,470,492 A 5/1949 Jenkins
2,505,122 A 4/1950 Krieger, Jr.
D149,920 S 8/1950 Pavlinetz
2,542,600 A 2/1951 Vaccarezza
2,610,400 A 9/1952 Wendling
2,752,678 A 7/1956 Welch
D184,317 S 1/1959 McArthur
3,014,277 A 12/1961 Geckler
3,121,951 A 2/1964 Green
3,138,871 A 6/1964 Sears
D199,630 S 11/1964 Dedic, Sr.
D209,704 S 12/1967 Siune et al.
D210,549 S 3/1968 O'Brien
3,586,161 A 6/1971 Fong et al.
3,596,965 A 8/1971 Woofter
3,630,249 A 12/1971 Brunwin
3,771,224 A 11/1973 Bono, Jr.
3,967,376 A 7/1976 Foley
D241,302 S 9/1976 Scigliano
3,991,466 A 11/1976 Smith
D249,926 S 10/1978 Wong
4,317,284 A 3/1982 Prindle
4,377,035 A 3/1983 Dalichow
D269,060 S 5/1983 Creamer
4,425,711 A 1/1984 Wood et al.
4,524,512 A 6/1985 Formo et al.
D284,442 S 7/1986 Chan
4,615,120 A * 10/1986 Newman ..... A47G 21/02 16/227
4,625,404 A 12/1986 Valente et al.
4,771,541 A 9/1988 Bouchakian
4,835,864 A 6/1989 Tang
4,984,367 A 1/1991 Albanese
4,995,154 A 2/1991 Bamber
D318,300 S 7/1991 Lillelund et al.
D318,600 S 7/1991 Lillelund et al.
D325,855 S 5/1992 Rea, Sr.
5,197,623 A 3/1993 Wang
5,251,758 A * 10/1993 Kolacek ..... A47G 21/00 206/459.5
D342,422 S 12/1993 Sanford
D347,975 S 6/1994 Zeller
5,327,650 A 6/1994 Rojas
D362,160 S 9/1995 Brabeck et al.
5,542,181 A 8/1996 Gaylord
D376,514 S 12/1996 Torkelson
D388,664 S 1/1998 Gagnon et al.
D391,123 S 2/1998 Rey et al.
5,735,050 A 4/1998 Hsieh
D396,613 S 8/1998 Cousins
D401,481 S 11/1998 Boilard et al.
5,845,403 A 12/1998 Nivin
5,904,250 A 5/1999 De Schutter
D412,813 S 8/1999 Roskind et al.
5,940,974 A 8/1999 Lee
D414,988 S 10/1999 Santini
6,055,733 A * 5/2000 Chen ..... A47G 21/10 16/429
6,116,450 A * 9/2000 Huang ..... B65D 51/246 215/228
6,145,204 A 11/2000 Cash
6,151,999 A 11/2000 Eklind
6,374,500 B2 * 4/2002 Stein ..... A47J 37/0786 30/160
6,463,662 B1 10/2002 Coscia et al.
6,647,828 B2 11/2003 Hakim
D491,419 S 6/2004 White et al.
D509,708 S 9/2005 Schmidt
7,013,568 B2 3/2006 Schmidt
D530,985 S 10/2006 Evans
D530,986 S 10/2006 Lago-Arenas
D533,034 S 12/2006 Wasserman
D535,857 S 1/2007 Bristow
D536,221 S 2/2007 Kamins
D536,222 S 2/2007 Heiberg et al.
D537,302 S 2/2007 Vrhovski
D554,951 S 11/2007 McGrath
D563,737 S 3/2008 Shane-Schuldt
D575,593 S 8/2008 Svartström
D587,075 S 2/2009 Dibnah et al.
D608,602 S 1/2010 Davies et al.
D609,060 S 2/2010 Pallotto
D612,692 S 3/2010 Menceles
D617,156 S 6/2010 Griffith
D618,070 S 6/2010 Jalet et al.
D625,153 S 10/2010 Gallop et al.
7,816,634 B1 10/2010 Guide, Jr. et al.
7,856,722 B2 12/2010 Lago-Arenas
D633,344 S 3/2011 Nordwall
D637,309 S 5/2011 Park
D656,799 S 4/2012 Lebeau
8,296,957 B2 10/2012 Muehlemann
D673,431 S 1/2013 Glavin et al.
D676,286 S 2/2013 Lion et al.
D686,045 S 7/2013 Stewart et al.
D690,156 S 9/2013 Apple et al.
8,635,780 B1 1/2014 Abul
8,689,453 B2 4/2014 Vogan
D705,020 S 5/2014 Fraser et al.
8,726,525 B2 5/2014 Bagley et al.
D706,586 S 6/2014 Kestenbaum
8,839,522 B2 9/2014 Walters
D718,093 S 11/2014 Miksovsky et al.
D722,837 S 2/2015 Miksovsky et al.
D730,049 S 5/2015 Miksovsky et al.
9,061,429 B2 6/2015 Barber
D739,685 S 9/2015 Miksovsky et al.
D740,079 S 10/2015 Miksovsky et al.
D745,339 S 12/2015 Cetti
D746,644 S 1/2016 Cai
D747,159 S 1/2016 Frost
D752,918 S 4/2016 Katopis
D753,447 S 4/2016 Busboom
D756,171 S 5/2016 Mou
D756,172 S 5/2016 Mou
D758,808 S 6/2016 Gatewood
9,434,590 B2 9/2016 Miksovsky et al.
9,468,321 B2 10/2016 Miksovsky et al.
9,549,626 B2 1/2017 Truog et al.

(56) References Cited

U.S. PATENT DOCUMENTS

| | | | | |
|---|---|---|---|---|
| D782,254 | S | 3/2017 | Joseph | |
| D794,400 | S | 8/2017 | Young | |
| D807,127 | S | 1/2018 | Levi | |
| D812,994 | S | 3/2018 | Mundhra | |
| D812,995 | S | 3/2018 | Mundhra | |
| D813,616 | S | 3/2018 | Mundhra | |
| D816,432 | S | 5/2018 | Huang | |
| D825,104 | S | 8/2018 | Simard et al. | |
| D828,730 | S | 9/2018 | Gauss et al. | |
| D834,887 | S | 12/2018 | Miksovsky et al. | |
| D842,662 | S | 3/2019 | Bloch et al. | |
| 10,518,402 | B1 * | 12/2019 | Polen | A47J 43/288 |
| 2003/0024126 | A1 * | 2/2003 | Liu | A47J 43/283 30/340 |
| 2003/0029044 | A1 | 2/2003 | Mattson et al. | |
| 2003/0110644 | A1 | 6/2003 | Miller | |
| 2005/0066531 | A1 | 3/2005 | Hougland | |
| 2005/0155229 | A1 | 7/2005 | Lee | |
| 2006/0248732 | A1 | 11/2006 | Straube | |
| 2007/0084063 | A1 | 4/2007 | Hughes | |
| 2007/0124943 | A1 | 6/2007 | Hougland | |
| 2007/0251103 | A1 * | 11/2007 | Rhodes, III | A47G 21/04 30/324 |
| 2008/0000092 | A1 | 1/2008 | Vanguard | |
| 2008/0016698 | A1 | 1/2008 | Simpson | |
| 2008/0148575 | A1 | 6/2008 | Chan | |
| 2008/0256807 | A1 | 10/2008 | Kirkup | |
| 2009/0172949 | A1 | 7/2009 | Watts | |
| 2009/0178284 | A1 * | 7/2009 | Lane | B26B 11/00 30/340 |
| 2009/0205209 | A1 | 8/2009 | Tovar | |
| 2009/0293283 | A1 | 12/2009 | Hsu | |
| 2010/0206885 | A1 | 8/2010 | Bowden et al. | |
| 2010/0218382 | A1 | 9/2010 | Scott | |
| 2011/0091521 | A1 | 4/2011 | Omelchenko | |
| 2012/0036724 | A1 | 2/2012 | Walters | |
| 2012/0297628 | A1 | 11/2012 | Rayko et al. | |
| 2013/0152406 | A1 | 6/2013 | McFarland | |
| 2014/0026425 | A1 | 1/2014 | Kim | |
| 2015/0014329 | A1 | 1/2015 | Konopatsky | |
| 2015/0257561 | A1 * | 9/2015 | Miksovsky | A47G 21/06 30/150 |
| 2015/0257562 | A1 | 9/2015 | Miksovsky et al. | |
| 2017/0000276 | A1 | 1/2017 | Miksovsky et al. | |
| 2019/0104873 | A1 | 4/2019 | Miksovsky et al. | |
| 2019/0110620 | A1 | 4/2019 | Miksovsky et al. | |
| 2019/0381651 | A1 * | 12/2019 | Miksovsky | B25G 1/04 |

FOREIGN PATENT DOCUMENTS

| | | |
|---|---|---|
| CN | 200945058 | 9/2007 |
| CN | 201691585 | 1/2011 |
| CN | 102068177 | 5/2011 |
| CN | 202234496 | 5/2012 |
| CN | 202874843 | 4/2013 |
| CN | 203424719 | 2/2014 |
| DE | 44 17 037 | 12/1998 |
| EP | 0 129 495 | 12/1984 |
| GB | 22788 | 9/1915 |
| GB | 1337613 | 11/1973 |
| JP | 2006-247086 | 9/2006 |
| WO | WO 2013/095407 | 6/2013 |
| WO | WO 2015/138218 | 9/2015 |

OTHER PUBLICATIONS

Alite, Cloverware 2.0, http://shop.alitedesigns.com/cloverware-538.html, downloaded on Mar. 6, 2014.
Guyot, Microbites™, https://www.guyotdesigns.com/product-microbites/, downloaded on Mar. 6, 2014.
Guyot, Utensils, https://www.guyotdesigns.com/utensils/, downloaded on Mar. 6, 2014.
International Search Report dated Jul. 8, 2015 from International Application No. PCT/US2015/019017.
Written Opinion dated Jul. 8, 2015 from International Application No. PCT/US2015/019017.
Chinese Office Action dated Apr. 27, 2017 from Chinese Application No. 201580022197.1.
Chinese Office Action dated Aug. 1, 2017 from Chinese Application No. 201611163525.2.
European Search Report dated Jun. 16, 2017 from European Application No. 16202786.3-1653.
European Office Action dated Oct. 17, 2018 from European Patent Application No. 16 202 786.6-1011.
Light My Fire, Spork original, http://www.lightmyfire.com/products/products/spork/spork-original.aspx, downloaded on Mar. 6, 2014.
Primus, Folding Spork, http://store.primuscamping.com/cookware/utensils-and-accessories/primus-folding-spork-black/, downloaded on Mar. 6, 2014.
DCI, Swivel Spork & Knife Set, http://shop.dcigift.com/p/swivel-spork-knife-set, downloaded on Mar. 6, 2014.
MSR Folding Camp Utensils, https://www.msrgear.com/cookware/folding-utensils, downloaded on Sep. 20, 2018.
GSI Outdoors, Telescoping Foon, http://www.gsioutdoors.com/telescoping-foon.html, downloaded on Sep. 20, 2018.
GSI Outdoors, Pivot Spatula, http://www.gsioutdoors.com/pivot-spatula.html, downloaded on Sep. 20, 2018.
Miksovsky et al., U.S. Appl. No. 29/653,512, filed Jun. 16, 2018.
Miksovsky et al., U.S. Appl. No. 29/653,595, filed Jun. 15, 2018.

* cited by examiner

TELESCOPING EATING UTENSIL

CROSS-REFERENCE TO RELATED APPLICATIONS

This application claims the benefit of U.S. Provisional Application No. 62/685,672, filed on Jun. 15, 2018. The foregoing application is hereby incorporated by reference herein for all purposes.

BACKGROUND OF THE INVENTION

The present invention relates generally to eating utensils. More particularly, the invention relates to telescoping eating utensils that may be suitable for transport.

Eating utensils are used by people all over the world to bring food to their mouths. Sometimes, eating utensils, such as knives, are used to cut food to a size and shape suitable for placing in a person's mouth. In some Asian countries, chopsticks are typically the only eating utensils used although spoons are also used for soups in Asia. In Western countries, forks, knives, and spoons are typically used as eating utensils. In still other countries, such as India and Ethiopia, hands are often used in place of utensils.

Although these existing utensils work quite well, there are continuing efforts to develop new utensils that provide not only improved function and convenience but are also suitable for transport. Such utensils also take up less space and are therefore more easily stored.

SUMMARY OF THE INVENTION

In accordance with an embodiment, a telescoping eating utensil is provided. The telescoping eating utensil includes a utensil tool and a handle. The utensil tool includes a utensil head attached to a tool connector, wherein a locking button is on a top surface of the tool connector, and the handle is configured to slidably engage and interlock with the tool connector. The handle and the tool connector are interlocked either in a collapsed mode or in an extended mode, and the locking button engages with an opening on the handle in the extended mode and the locking button engages with a recess in a bottom surface of the handle in the collapsed mode.

In accordance with another embodiment, an expandable eating utensil is provided. The expandable eating utensil includes a tool portion, a handle portion, and a locking feature. The tool portion includes a utensil head and the handle portion is configured to slidably engage with the tool portion. The locking feature is configured for interlocking the handle portion with the tool portion such the tool portion can be locked in place relative to the handle portion.

In accordance with yet another embodiment a telescoping eating utensil is provided. The telescoping eating utensil includes a utensil tool portion and a handle portion configured to slidably engage with the utensil tool portion. The utensil tool portion includes a utensil head attached to a tool connector having an actuatable locking button on a top surface of the tool connector. The handle portion interlocks with the tool connector in either a collapsed mode or an extended mode when the locking button is in a relaxed state.

BRIEF DESCRIPTION OF THE DRAWINGS

The invention, together with further objects and advantages thereof, may best be understood by reference to the following description taken in conjunction with the accompanying drawings in which.

DETAILED DESCRIPTION OF THE PREFERRED EMBODIMENTS

The present invention relates generally to combination eating utensils.

Referring to FIGS. 1A-8D, telescoping eating utensils in accordance with one embodiment of the invention will be described. Embodiments of a telescoping spoon 100 and a telescoping fork 200 are described herein. The telescoping spoon 100 and fork 200 can be used in an extended mode for eating and then collapsed for convenient storage and transport. To form a longer, extended utensil, the handle of the utensil can be extended and locked in place, as described in more detail below.

Figure 1A:
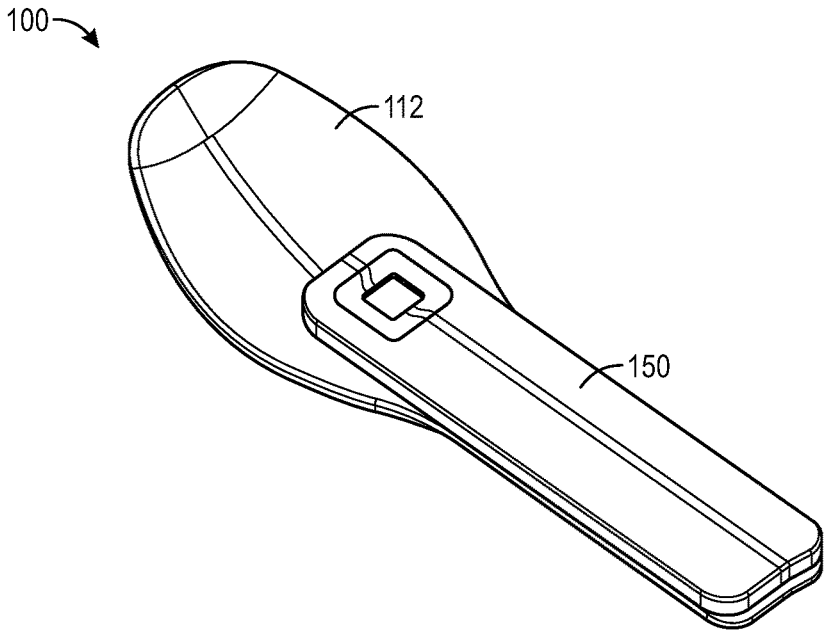
FIG. 1A is a top perspective of a telescoping spoon in its collapsed mode in accordance with an embodiment.
Figure 1B:
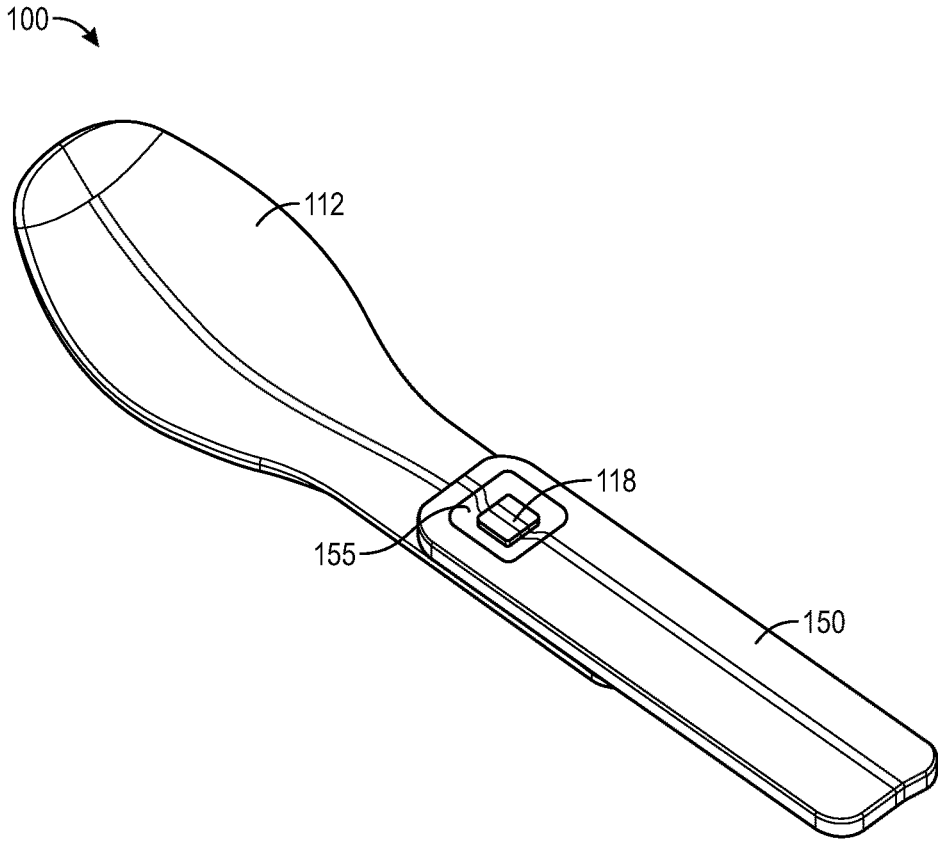
FIG. 1B is a top perspective view of the telescoping spoon shown in FIG. 1A in its extended mode.
Figure 2A:
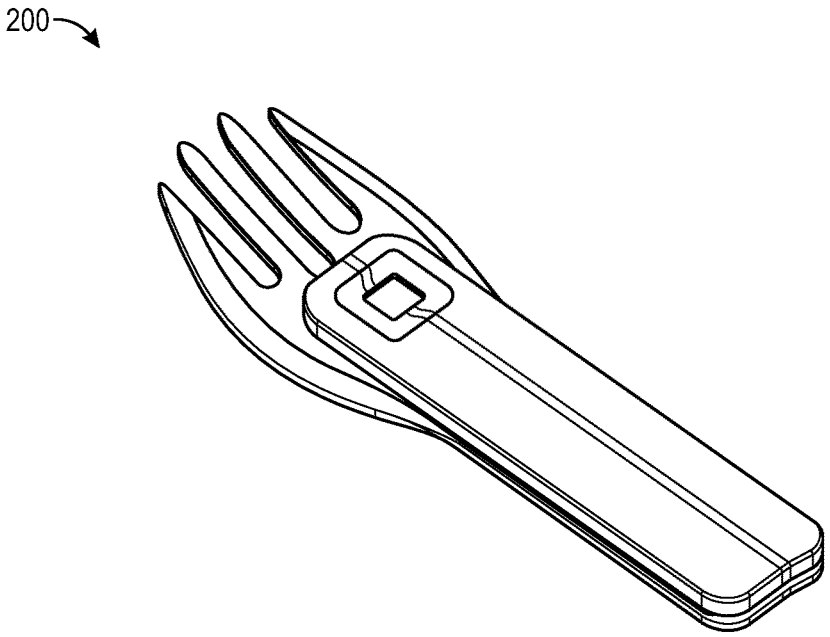
FIG. 2A is a top perspective view of a telescoping fork in its collapsed mode in accordance with an embodiment.
Figure 2B:
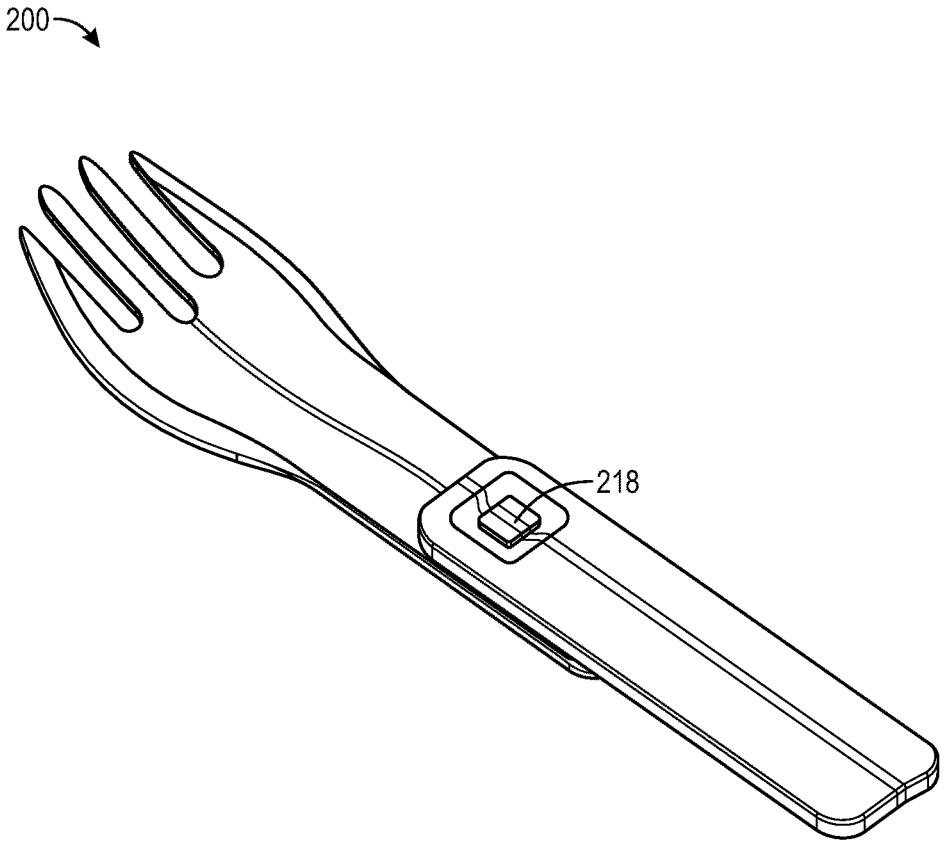
FIG. 2B is a top perspective view of the telescoping fork shown in FIG. 2A in its extended mode.

FIGS. 1A and 1B are top perspective views of the telescoping spoon 100 in its collapsed mode and in its extended mode, respectively, in accordance with an embodiment. FIGS. 2A and 2B are top perspective views of the telescoping fork 200 in its collapsed mode and in its extended mode, respectively, in accordance with an embodiment.

As shown in FIGS. 1A and 1B, a telescoping spoon 100 can be moved between a collapsed mode and an extended mode. FIG. 1A shows the telescoping spoon 100 in a collapsed mode, which is convenient for storage and transport. The spoon 100 can also be extended, as shown in FIG. 1B, such that it has a longer length for ease and comfort when used as an eating utensil.

Similarly, as shown in FIGS. 2A and 2B, a telescoping fork 200 can be moved between a collapsed mode and an extended mode. FIG. 2A shows the telescoping fork 200 in a collapsed mode, which is convenient for storage and transport. The fork 200 can also be extended, as shown in FIG. 2B, such that it can be used as an eating utensil with comfort and ease. According to an embodiment, the utensil has a length of about 4.4 inches in the collapsed mode and about 6.3 inches in the extended mode.

Figure 3A:
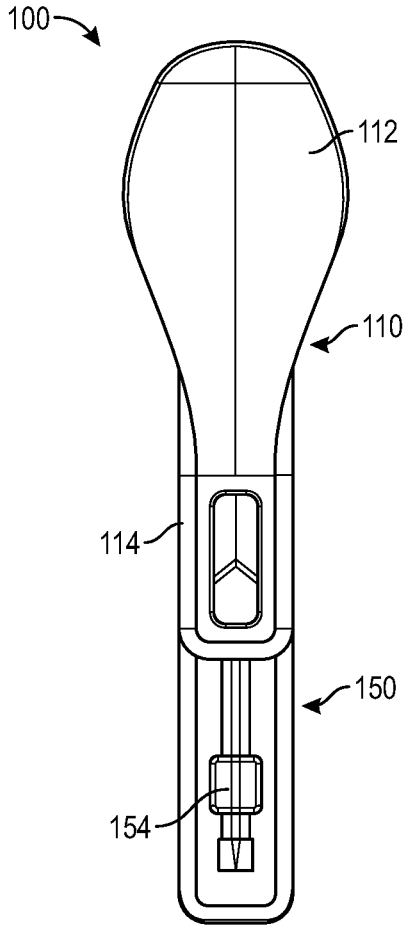
FIG. 3A is a bottom plan view of the embodiment of the telescoping spoon in its extended mode shown in FIG. 1B.
Figure 3B:
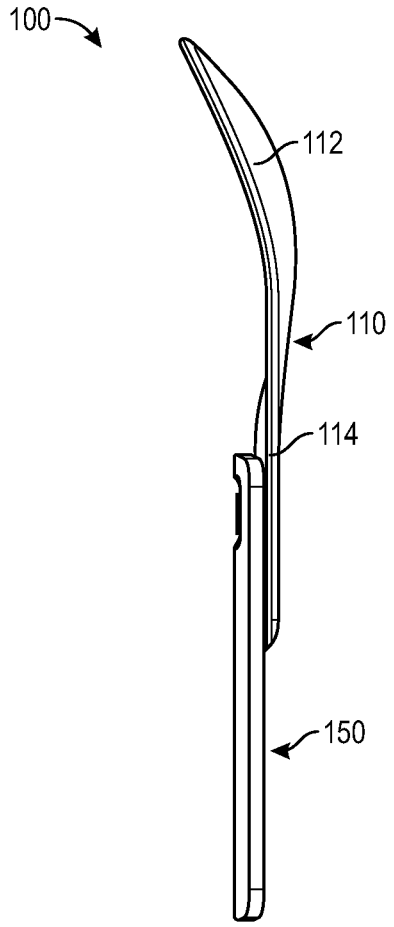
FIG. 3B is a side view of the embodiment shown in FIGS. 1B and 3A.
Figure 3C:
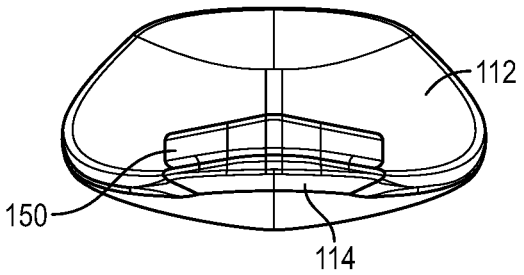
FIG. 3C is an end view of the embodiment shown in FIGS. 1B, 3A, and 3B.

FIGS. 3A-3C show a bottom plan view, a side view, and an end view of the spoon 100. As shown in FIGS. 3A and 3B, the spoon 100 includes two separate parts that can be slidably connected: the spoon tool 110 and the handle 150. The spoon tool 110 includes a bowl 112 and a tool connector 114.

Figure 4A:
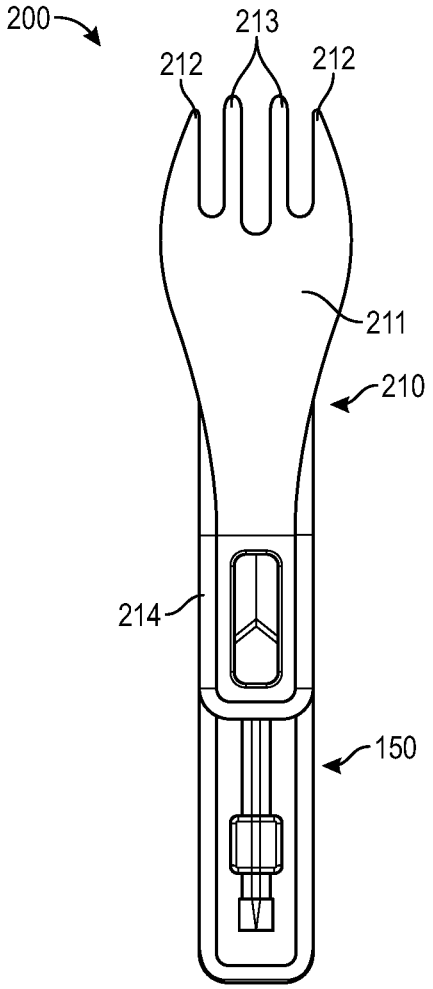
FIG. 4A is a bottom plan view of the embodiment of the telescoping fork in its extended mode shown in FIG. 2B.
Figure 4B:
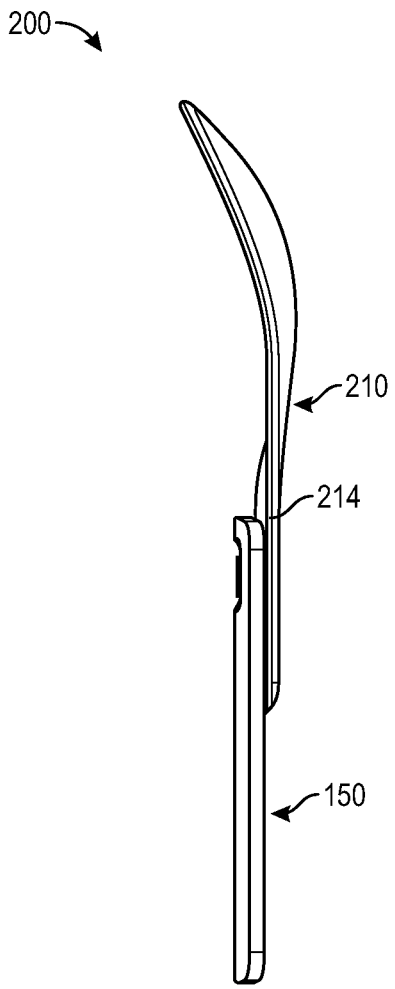
FIG. 4B is a side view of the embodiment shown in FIGS. 2B and 4A.
Figure 4C:
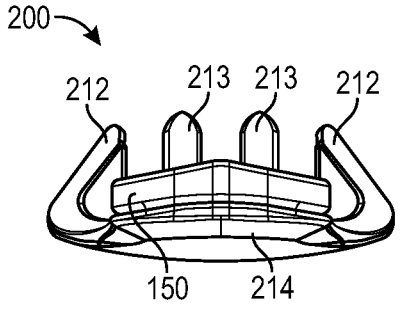
FIG. 4C is an end view of the embodiment shown in FIGS. 2B, 4A, and 4B.

FIGS. 4A-4C show a bottom plan view, a side view, and an end view of the fork 200. As shown in FIGS. 4A and 4B, the fork 200 includes two separate parts: the fork tool 210 and the handle 150. The fork tool 210 includes tines 212, 213 and a tool connector 214.

Figure 5B:
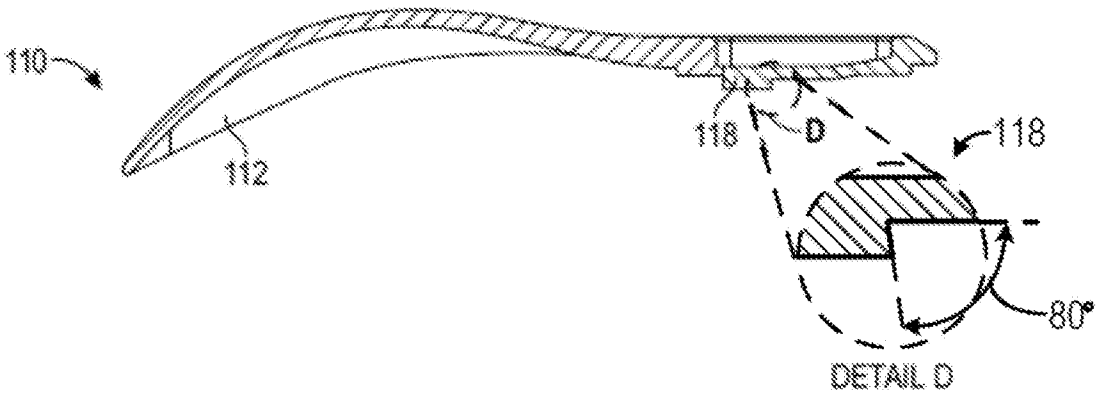
FIGS. 5A-5E show various views of an embodiment of a spoon tool in accordance with an embodiment.
Figure 5C:
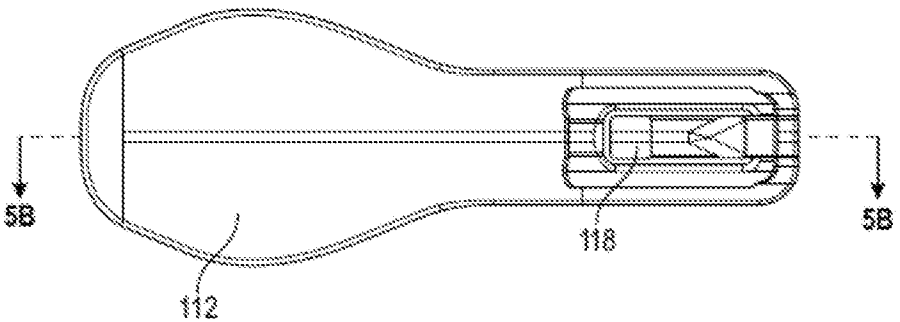
Figure 5D:
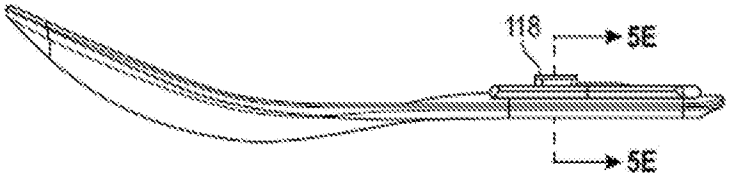
Figure 5A:
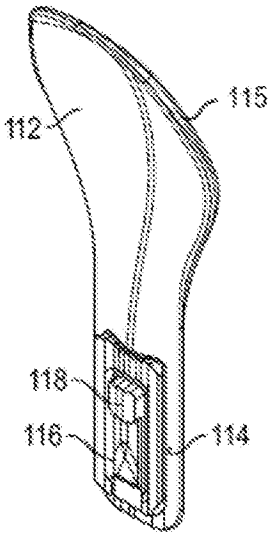
Figure 5E:
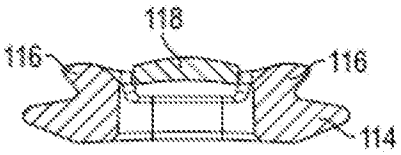

FIGS. 5A-5E show different views of an embodiment of the spoon tool 110. FIG. 5B is a side cross-sectional view of the spoon tool 110 taken along line 5B-5B of FIG. 5C. FIG. 5E is a cross-sectional view of the spoon tool taken along line 5E-5E of FIG. 5D. The spoon tool 110 includes a tool connector 114 attached to a proximal end of the spoon bowl 112. An elongated tail 116 on the upper surface of the tool connector 114 can be slid in a socket 158 between a pair of rails 152 on the underside of the handle 150 to form a dovetail joint between the tool connector 114 and the handle 150. The spoon tool connector 114 and the handle 150 slide together to form the telescoping spoon 100, as described in more detail below. It will be appreciated that the dovetail joint is moldable and permits translation of the parts, but resists other forces (e.g. pressing on the side of the fork to split a piece of food—a lateral side force, or scooping ice cream—a "frontal" bending force).

Figure 6B:
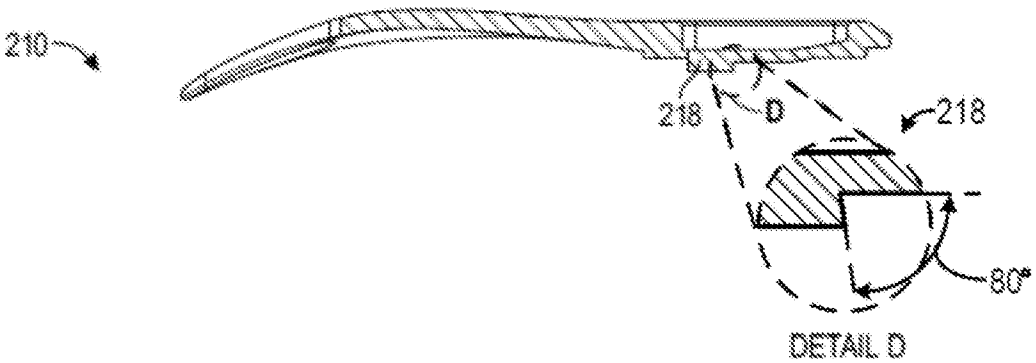
FIGS. 6A-6E show various views of an embodiment of a fork tool in accordance with an embodiment.
Figure 6C:
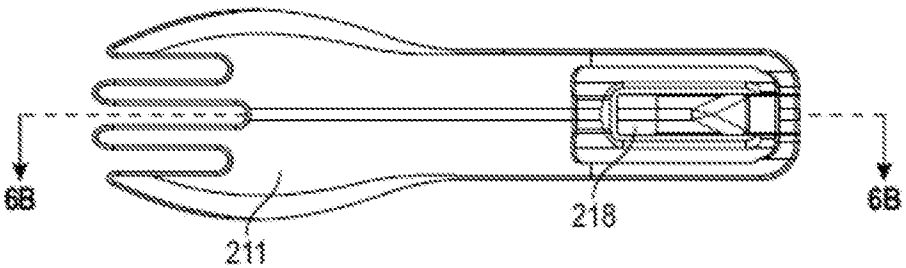
Figure 6D:
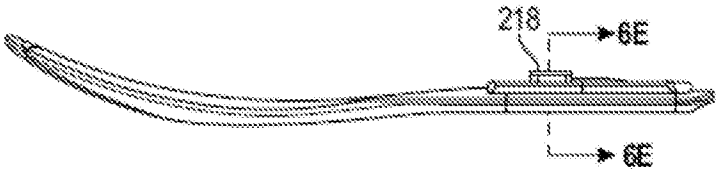
Figure 6A:
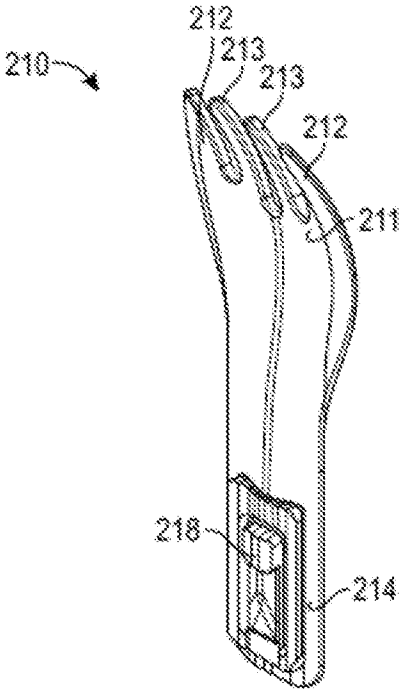
Figure 6E:
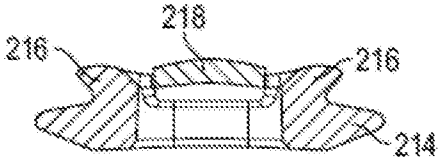

Similarly, the fork tool connector 214 and the handle 150 slide together to form the telescoping fork 200. As shown in FIGS. 6A-6E, which show various views of an embodiment of a fork tool 210, a tool connector 214 is attached to the proximal end of the fork tool head 211, which includes tines 212, 213. FIG. 6B is a side cross-sectional view of the spoon tool 110 taken along line 6B-6B of FIG. 6C. FIG. 6E is a cross-sectional view of the spoon tool taken along line 6E-6E of FIG. 6D. An elongated tail 216 on the upper surface of the tool connector 214 can be slid in a socket 158 between a pair of rails 152 on the underside of the handle 150 to form a dovetail joint between the tool connector 214 and the handle 150. The fork tool connector 214 and the handle 150 slide together to form the telescoping fork 200, as described in more detail below. It will be appreciated that the dovetail joint is moldable and permits translation of the parts, but resists other forces (e.g. pressing on the side of the fork to split a piece of food—a lateral side force, or scooping ice cream—a "frontal" bending force).

FIG. 5E is a cross-sectional view of the tool connector 114 taken along the line 5E-5E of FIG. 5D. As shown in FIG. 5E, the elongated tail 116 is on the upper surface of the tool connector 114, and the locking button 118 is also on the upper surface of the tool connector 114. There is a void below the locking button 118, as shown in FIG. 5E, to allow the locking button 118 to be actuated or depressed by a user such that it can be slid under the handle 150. It will be noted that, without any force applied, the locking button 118 is in a relaxed state, as shown in FIG. 5E (i.e., not actuated or pushed down). In the illustrated embodiments, the locking button 118 has a "dive-board" configuration, which is described in more detail below.

In the extended mode, the locking button 118 extends into an opening 151 on the handle 150, as shown in FIG. 1B. In the illustrated embodiment, the opening 151 on the handle 150 is positioned as close as possible to the proximal end of the handle in order to provide the longest length possible for the spoon 100 in the extended mode while still being firm and rigid in the extended mode. The locking button 118 is preferably positioned well away from the spoon bowl 112 so that it is less likely for food to get into the mechanism.

The handle 150 of the spoon 100 and fork 200 will be described with reference to FIGS. 7A-7E, which represent various views of the handle 150. The handle 150 of the spoon 100 is the same as the handle 150 of the fork 200. The handle 150 has a pair of rails 152 on the bottom side of its two outer edges, forming an elongated socket 158 between the rails 152. The rails 152 aid in guiding the handle 150 over the spoon tool connector 114 or the fork tool connector 214 when the tail 116, 216 of the spoon tool connector 114 or fork tool connector 214 is slid along the socket 158 between the rails 152. The tail 116, 216 of the tool connector 114, 214 can be slid between the rails 152 to place the spoon 100 or fork 200 in either the collapsed mode (as shown in FIGS. 1A and 2A) or in the extended mode (as shown in FIGS. 1B and 2B), as will be described in more detail below. The rails 152 also secure the spoon tool connector 114 or fork tool connector 214 to the handle 150, as will be explained in more detail below.

The outer edge of each rail 152 is aligned and continuous with the outer edge of the rest of the handle 150. Further, the rails 152 taper inward so that the portion of the handle 150 with the rails 152 does not feel different from the rest of handle 150 when the utensil 100, 200 is held in a user's hand.

Figure 7A:
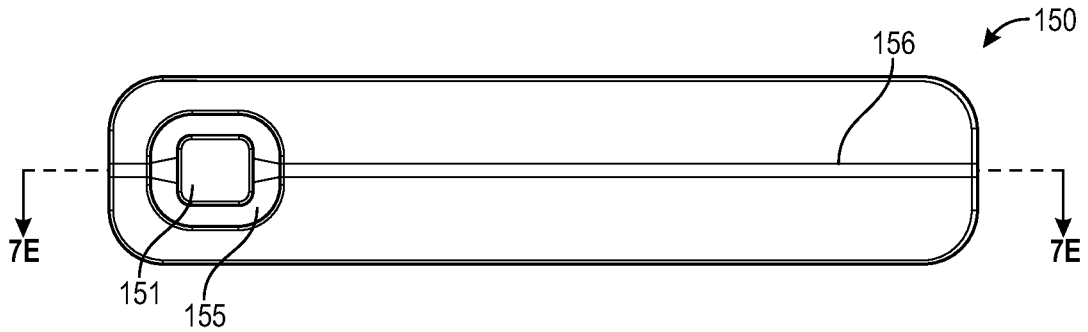
FIG. 7A-7E show various views of an embodiment of a handle in accordance with an embodiment.
Figure 7B:
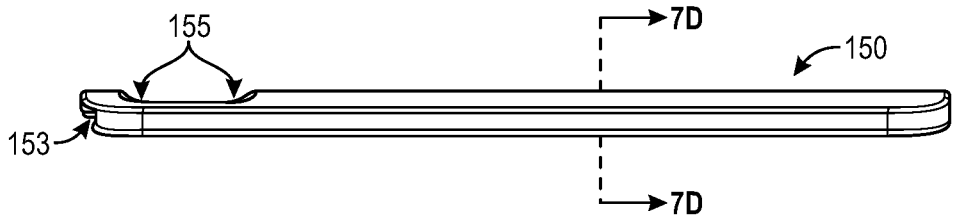
Figure 7C:
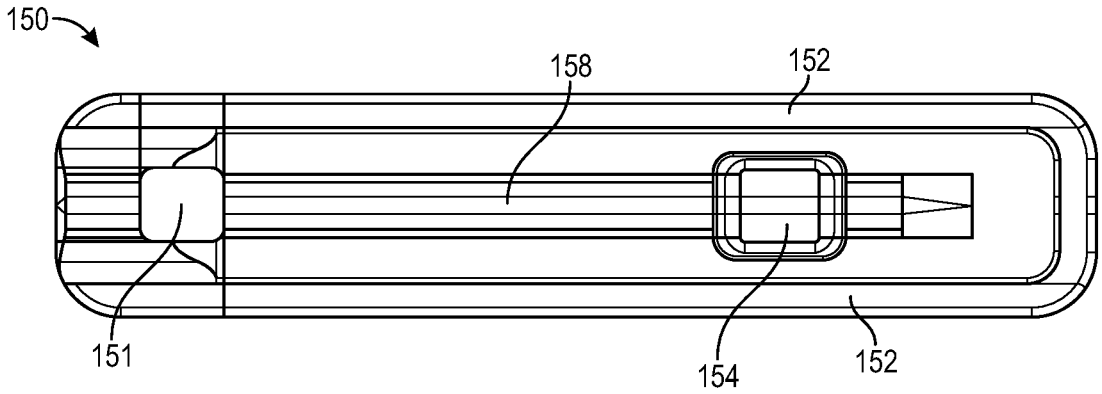

As shown in FIG. 7C, the bottom of the handle 150 also includes a recess 154 that accommodates the locking button 118, 218 of the tool connector 114, 214 when the spoon 100 or fork 200 is in the fully collapsed mode. When the telescoping spoon 100 or telescoping fork 200 is in its fully collapsed mode, the recess 154 allows the locking button 118, 218 to extend into the recess 154 to be in its relaxed state. The locking button 118, 218 and recess 154 also serve to snap and lock the tool connector 114, 214 in place relative to the handle 150 when the spoon 100 or fork 200 is in the fully collapsed mode. According to an embodiment, the recess 154 in the handle 150 provides a subtle detent feel as the locking button 118, 218 comes to relax into this recess 154 when in the collapsed mode.

As shown in the illustrated embodiment, in extended mode, the locking button 118, 218 sits in a well or depression 155 around the opening 151 in the handle 150. This well 155 allows the locking button 118, 218 to be locally "proud" such that it can be actuated with a finger or something similarly sized, but if a larger surface (sized larger than an average finger) is applied across the area of the well 155, the top surfaces of the handle 150 itself would prevent the locking button 118, 218 from being actuated. Thus, the well 155 helps to prevent accidental actuation of the locking button 118, 218.

Figure 7D:
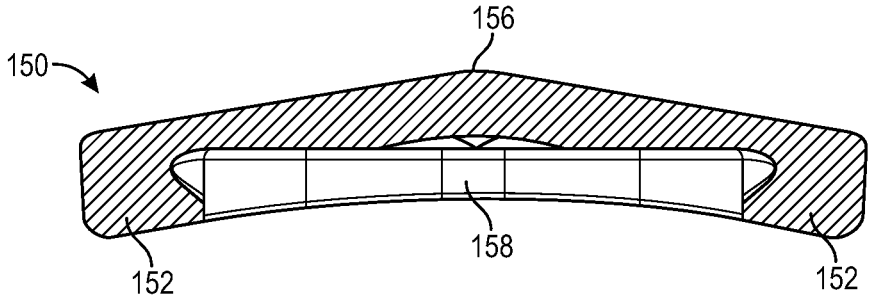
Figure 7E:
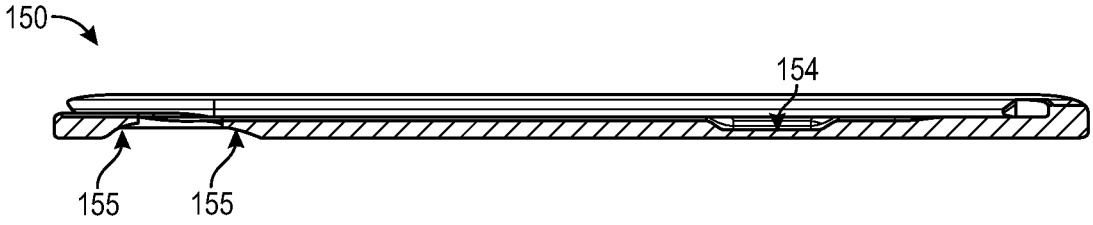

FIG. 7D is a cross-sectional view of the handle 150 taken along the line 7D-7D in FIG. 7B. As shown in FIG. 7D, the handle 150 has a slight upside down V-shape with a ridge 156 in the center when viewed from an end. The center ridge 156 is the highest point of the handle 150 and runs down the center along substantially the entire length of the handle 150. Each side of the handle 150 angles downward from the center line to the edge at an angle about 75-80 degrees, and preferably about 79 degrees. FIG. 7E is a longitudinal cross-sectional view of the handle taken along the line 7E-7E of FIG. 7B.

The geometries of the spoon 100 and the fork 200 will be described below. In the illustrated embodiment, the fork 200 has four tines 212, 213. Each tine 212, 213 has a sharp crest, which aids in spearing or piercing pieces of food so that the food can be picked up by the fork 200. It will be understood that, in other embodiments, the fork can have more or fewer tines. Each tine 212, 213 has a pointed tip, which aids in spearing or piercing pieces of food so that the food can be picked up by the fork. In the illustrated embodiment, the two center tines 213 are straight and the two outer tines 212 each have a straight inner edge and a curved outer edge. The curvature of the outer edges can also be used for scraping food, as the curved edges follow the curvature of a curved container, such as a bowl, better than the straight tines of many conventional forks.

In addition to being curved, the outer edges of the outer tines 212 are also tapered or chamfered such that the fork can be used to cut through or separate foods that do not require a knife. As illustrated in FIG. 4C, the top surface of each of the outer edges of the outer tines 212 is tapered or chamfered. In a particular embodiment, the outer edges are chamfered at an angle of about 20-25 degrees, and preferably at an angle of about 23 degrees. The outer edges 145 have an edge width of about 1 mm at its widest point. In the illustrated embodiment, the outer edges of both outer tines 212 are chamfered so that both outer edges can easily be used to cut or separate food regardless of whether the user is right-handed or left-handed.

The spoon bowl 112 has a substantially flat side edge 115, which allows for "scraping" food from of a container (e.g., a yogurt container) or a bowl. A conventional spoon typically has a rounded edge that is not particularly effective for scraping. As illustrated, the side edge 115 of the bowl 112 of the spoon 100 is substantially flat, thus providing an effective surface for scraping. In the illustrated embodiment, the bowl 112 has a substantially elongated five-sided shape with rounded corners.

The telescoping spoon 100 and fork 200 are formed of a plastic material, such as a glass reinforced thermoplastic, that is suitable for food contact and is injection moldable. A particularly suitable reinforced thermoplastic for forming the spoon 100 and fork 200 is glass filled nylon. According to other embodiments, the telescoping spoon 100 and fork 200 can be formed of a variety of food-safe plastics and potentially even metal. In addition to glass filled nylon, some suitable plastic materials include nylon, polycarbonate, polypropylene, and co-polyester. Compared with unreinforced nylon, glass filled nylon has increased structural strength and stiffness. Suitable materials include those that exhibit high stiffness (so the utensils do not flex very much when being used, i.e. are not "flimsy"), but that can also afford some flex (for the locking button 118, 218 to be depressed).

As described above, there is a recess 154 in the bottom surface of the handle 150 that is configured to receive the locking button 118, 218 on the tool connector 114, 214 when the spoon 100 or fork 200 is in the fully collapsed mode. To assemble the spoon 100 or fork 200, the tool connector 114, 214 is first positioned underneath the handle 150 and slid longitudinally along the socket 158, with the outer side edges of the tail 116 between the rails 152, toward the distal end of the handle 150 until the locking button 118, 218 engages and extends into the opening 151 and returns to its relaxed state in the opening 151. It will be understood that the locking button 118, 218 is automatically actuated when it come into contact with the handle 150. The open end 153 of the handle 150 (as shown in 118, 218 without any need for a user to actuate the locking button 118, 218. FIGS. 7B and 8D) can be designed with a rounded or curved end such that the tool connector 114, 214 can simply be inserted into the open end 153 of the handle 150 and the rounded or curved end 153 automatically pushes down or actuates the locking button.

It will be noted that the position of the recess 154 in the bottom surface of the handle 150 near the distal end of the handle 150 allows the handle 150 to extend over a portion of the tool in the collapsed mode, thereby allowing for a shorter overall length of the spoon 100 or fork 200 in the collapsed mode. It will be understood that the shorter length allows for more convenient storage and transport. As shown in FIG. 8C, the proximal end of the handle 150 (including the opening 151) extends over a portion of the utensil head.

When the locking button 118, 218 engages the opening 151, the spoon tool 110 or fork tool 210 is interlocked with the handle 150 in the extended mode and fairly significant force is required to disengage the spoon tool 110 or fork tool 210 from the handle 150 from this position. The locking button 118, 218 extends from the top surface of the tool connector 114, 214 at an angle of 90° or less, preferably in a range of about 60°-90°.

As shown in the illustrated embodiments in the detailed view of FIGS. 5B and 6B, the back (facing the proximal end of the tool 110, 210) of the locking button 118, 218 extends from the top surface of the tool connector 114, 214 at an angle of about 80° such that the locking button 118, 218 can be actuated and return to its relaxed stated in the opening 151 or the recess 154 of the handle 150. The less than 90° angle on the back of the locking button 118, 218 prevents the tool 110, 210 from accidentally/unintentionally collapsing when the utensil head is pressed hard into something (e.g., pressing tines of a form into a raw carrot). It will be appreciated that, compared to the 90° angle, the 80° angle allows the locking button 118, 218 to more securely engage the edge of the opening 151 to prevent accidental disengagement from the extended mode. It will be understood that the smaller the angle between the side of the locking button 118, 218 and the top surface of the tool connector 114, 214, greater the force necessary to disengage the locking button 118, 218 from the opening 151.

Various longitudinal cross-sectional views of a spoon 100, as shown in FIGS. 8A-8D, help illustrate how the angle of the back of the locking button 118 prevents accidental actuation. It will be understood that the locking button 218 of a fork 200 would function the same way and thus, even though the locking button is described with reference to the spoon 100, it will be understood that the description would apply to the locking button 218 of the fork 200 as well. The angle on the locking button 118, 218 helps to ensure that the locking button 118, 218 stays in place and is not actuated by the longitudinal compressive force (e.g., of stabbing action of fork). It will be noted that the dovetail does absorbs side-to-side forces (e.g. pressing on the handle to split a piece of food) and bending forces (e.g. digging out some hard ice cream with the spoon).

Figure 8A:
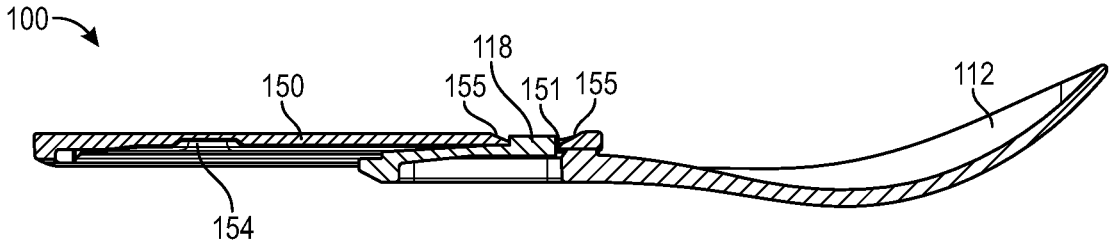
FIGS. 8A-8D show various cross-sectional view of an embodiment.
Figure 8B:
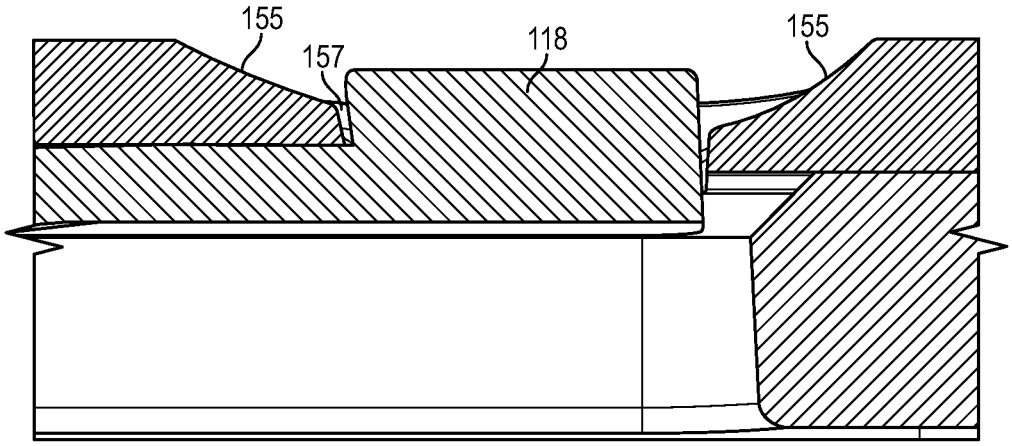
Figure 8C:
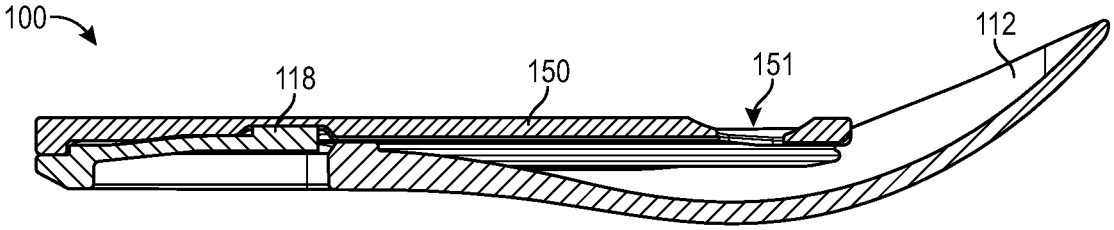
Figure 8D:
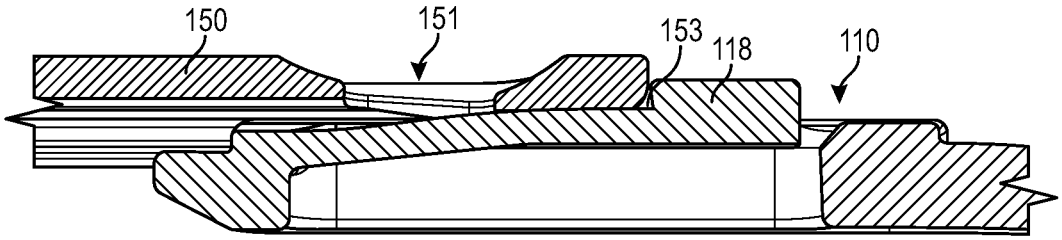

FIG. 8A is a longitudinal cross-sectional view of a spoon 100 in the extended mode. As shown in FIG. 8A, the locking button 118 is in a relaxed state within the opening 151 of the handle 150. As described above, the opening 151 is surrounded by a well 155. As shown in FIG. 8A, the top surface of the locking button 118 is below the top surface of the handle 150 to prevent accidental actuation of the locking button 118. It will be noted that the mating face 157 on the handle 150 (that mates to the 80° button face) is angled as well to further hold the locking button 118 in place. The angle of the mating face is preferably at least 60° and less than 90°. The mating face 157 and locking button 118 are shown in more detail in FIG. 8B.

As shown in the illustrated embodiment of FIGS. 8A-8D, the "dive board" of the locking button 118 is positioned longitudinally on the tool connector 114. In alternative embodiments, the locking button can be connected on a side, so instead of pressing down on the button, the button would be pushed laterally to a side to actuate it. The longitudinal positioning, as shown in the illustrated embodiment, allows the material geometry to absorb all of the load. The illustrated locking button dive board naturally resists longitudinal forces, but is easily depressed for unlocking.

It will be understood that the opening 151 and recess 154 together with the locking button act as a hard stop, preventing the spoon tool 110 from being slid further. The recess 154 prevents the spoon tool 110 from moving from the collapsed mode and the opening 151 prevents the spoon tool 110 from moving back in the opposite direction to disengage from the handle 150. The rails 152 and tail 116 and the dovetail joint formed thereby prevent the handle 150 and spoon tool 110 from being separated in the z-direction. The dovetail design is preferable relatively "open" so that it is easy to clean.

To disengage the spoon tool 110 and the handle 150 from the extended mode, the user pushes down on the locking button 118, 218 and either slides the spoon bowl 112 toward the distal end of the handle 150 to collapse the spoon 100 or slides the spoon tool 110 away from the handle 150 to disengage the spoon tool 110 from the handle 150. The spoon tool 110 and the handle 150 can be separated when the user pushes down on the locking button 118 and simply slides the spoon tool 110 and the handle 150 away from one another in the longitudinal direction. If desired, the user can thoroughly clean the spoon tool 110 and the handle 150 when separated.

In the fully collapsed mode, the locking button 118 engages the recess 154 and snaps into the recess 154 and resumes its relaxed state within the recess 154. FIG. 8C shows the spoon 100 in the fully collapsed mode.

With enough force applied to the locking button 118, the spoon tool connector 114 will move under the handle 150 and the elongated tail 116 can slide along the socket 158 between the rails 152 until the locking button 118 is once again in its relaxed state, either engaging the recess 154 in the fully collapsed mode or engaging the opening 151 in the fully extended mode. When the spoon tool 110 and the handle 150 are positioned to slidably engage one another, as shown in the longitudinal cross-sectional view of FIG. 8D, the curved or rounded end open end 153 of the handle allows the user to simply insert the spoon tool 110 into the open end 153 of the handle 150 and the rounded or curved end 153 automatically actuates the locking button 118, 218 without any need for a user to apply force directly to the locking button 118, 218.

It will be understood that operation of the fork tool 210 with respect to the handle 150 can be performed the same way as the operation of the spoon tool 110 described above. It will also be noted that all parts of the spoon 100 and fork 200 are easily moldable with plastic injection molding in accordance with an embodiment.

Although only a few embodiments of the invention have been described in detail, it should be appreciated that the invention may be implemented in many other forms without departing from the spirit or scope of the invention. In view of all of the foregoing, it should be apparent that the present embodiments are illustrative and not restrictive and the invention is not limited to the details given herein, but may be modified within the scope and equivalents of the appended claims.

What is claimed is:

1. A telescoping eating utensil, comprising:

a utensil tool comprising a utensil head attached to a tool connector connected to a proximal end of the utensil head, wherein a locking button is on a top surface of the tool connector, and one side of the locking button is connected to the tool connector such that the locking button has a dive board configuration; and a handle configured to slidably engage and interlock with the tool connector, wherein the handle and the tool connector are interlocked either in a collapsed mode or in an extended mode, and wherein the locking button engages with an opening on the handle in the extended mode and the locking button engages with a recess in a bottom surface of the handle in the collapsed mode.

2. The telescoping eating utensil as recited in claim 1, wherein the utensil head comprises a spoon bowl.

3. The telescoping eating utensil as recited in claim 2, wherein the spoon bowl further comprises a bowl portion having a substantially flat side edge.

4. The telescoping eating utensil as recited in claim 1, wherein the utensil head comprises a fork head.

5. The telescoping eating utensil as recited in claim 4, wherein the fork head has a plurality of tines, wherein at least one of the tines on an outer edge of the fork head has a curved chamfered outer edge.

6. The telescoping eating utensil as recited in claim 5, wherein each of the tines has a pointed end.

7. The telescoping eating utensil as recited in claim 1, wherein the locking button extends from the top surface of the tool connector at an angle of 90 degrees or less.

8. The telescoping eating utensil as recited in claim 7, wherein the locking button extends from the top surface of the tool connector at an angle of 80 degrees.

9. The telescoping eating utensil as recited in claim 1, wherein the telescoping eating utensil is formed of a glass reinforced thermoplastic material.

10. An expandable eating utensil, comprising:

a tool portion comprising a utensil head;

a handle portion configured to slidably engage with the tool portion; and a locking feature for interlocking the handle portion with the tool portion such that the tool portion can be locked in place relative to the handle portion, wherein the locking feature comprises a locking button having one side connected to the tool portion such that the locking button has a dive board configuration, wherein the locking feature prevents the tool portion from being disengaged from the handle portion in a longitudinal direction, wherein the locking feature further comprises an opening on the handle portion and a recess in a bottom surface of the handle portion, and wherein the locking button is configured to engage with the opening on the handle portion in an extended mode, and the locking button is configured to engage with the recess in a collapsed mode, wherein the utensil is longer in the extended mode compared to the collapsed mode.

11. The expandable eating utensil as recited in claim 10, wherein the handle portion extends over at least a portion of the utensil head in a collapsed mode.

12. The expandable eating utensil as recited in claim 10, wherein the utensil head comprises a spoon head.

13. The expandable eating utensil as recited in claim 10, wherein the utensil head comprises a fork head.

14. The expandable eating utensil as recited in claim 13, wherein the fork head has a plurality of tines, wherein at least one of the tines on an outer edge of the fork head has a curved chamfered outer edge.

15. A telescoping eating utensil, comprising:

a utensil tool portion comprising a utensil head attached to a tool connector having an actuatable locking button on a top surface of the tool connector, wherein one side of the locking button is connected to the tool connector such that the locking button has a dive board configuration; and a handle portion configured to slidably engage with the utensil tool portion, wherein the handle portion interlocks with the tool connector in either a collapsed mode or an extended mode when the locking button is in a relaxed state, wherein the locking button engages with an opening on the handle portion in the extended mode and is in the relaxed state while the locking button is engaged with the opening, and wherein the locking button engages with a recess in a bottom surface of the handle portion in the collapsed mode and is in the relaxed state while the locking button is engaged with the recess.

16. The telescoping eating utensil as recited in claim 15, wherein the locking button is in an actuated state when the handle portion is being slid relative to the utensil tool portion.

17. The telescoping eating utensil as recited in claim 16, wherein a portion of the tool connector can be slid in a socket between a pair of rails on an underside of the handle portion to form a dovetail joint between the tool connector and the handle portion.

18. The telescoping eating utensil as recited in claim 17, wherein the handle portion has a curved end surface for contacting and actuating the locking button when the tool connector is slid into the socket.

* * * * *